US011766716B2

(12) United States Patent
Burkholder et al.

(10) Patent No.: US 11,766,716 B2
(45) Date of Patent: Sep. 26, 2023

(54) SYSTEM AND METHOD OF INCREASING COOLING RATE OF METAL SAND CASTING DURING SOLIDIFICATION

(71) Applicant: GM Global Technology Operations LLC, Detroit, MI (US)

(72) Inventors: Steven L. Burkholder, Archbold, OH (US); Thomas W. Gustafson, Clarkston, MI (US); Qigui Wang, Rochester Hills, MI (US); Anil K. Sachdev, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 40 days.

(21) Appl. No.: 17/568,047

(22) Filed: Jan. 4, 2022

(65) Prior Publication Data

US 2023/0211406 A1 Jul. 6, 2023

(51) Int. Cl.
*B22D 27/04* (2006.01)
*B22D 30/00* (2006.01)

(52) U.S. Cl.
CPC ..... *B22D 27/04* (2013.01); *B22D 30/00* (2013.01)

(58) Field of Classification Search
None
See application file for complete search history.

(56) References Cited

U.S. PATENT DOCUMENTS 10,086,430 B2 * 10/2018 Puy ..... B22D 19/04
2015/0000855 A1 * 1/2015 Schwam ..... B22C 9/02 164/364

FOREIGN PATENT DOCUMENTS

EP 0065208 B2 12/1990
JP 57202943 A * 12/1982 ..... B22C 9/126

* cited by examiner

*Primary Examiner* — Scott R Kastler
(74) *Attorney, Agent, or Firm* — Vivacqua Crane, PLLC

(57) ABSTRACT

A system and method of increasing a cooling rate of a metal sand casting during solidification. The system includes a 3-D printed manufactured sand mold defining a mold cavity, a coolant inlet port extending into the manufactured sand mold, a myriad of coolant passageways surrounding a portion of the mold cavity, and a coolant outlet port in fluid communication with the coolant passageways. The system further includes a coolant vapor extraction system having a collection manifold in fluid connection with the outlet port of the sand mold. A molten metal is poured into the mold cavity and a liquid coolant is introduced into the sand mold. The liquid coolant changes state into a gas phase as it permeates through the sand mold, thereby increasing the cooling rate of the casting. The liquid coolant may be that of a liquid nitrogen.

20 Claims, 3 Drawing Sheets

SYSTEM AND METHOD OF INCREASING COOLING RATE OF METAL SAND CASTING DURING SOLIDIFICATION

INTRODUCTION

The present disclosure relates to metal sand casting, more specifically to a system and method of increasing the cooling rate of aluminum sand casting during solidification.

Sand casting is commonly used in casting aluminum automotive components such as engine blocks and cylinder heads. In manufacturing a typical sand mold, sand is bound together and shaped to conform to the negative impression of the desired automotive component or workpiece. Molten aluminum is poured into the negative impression, also known as a mold cavity. Upon cooling and solidification, the cast aluminum component has the shape and geometry of the desired automotive component.

A typical sand mold is made of sand particles held together with an organic or inorganic binding agent. After the poured aluminum has solidified and cooled to room temperature, the sand mold is broken open to remove the cast component. The main advantage of sand casting is the low cost of the sand molds and casting process. After casting, the sand can be reclaimed and reused. Sand casting is suitable for low-volume and mass production of cast components having intricate shapes. However, sand casting does not permit close tolerances, and the mechanical properties of the sand castings are relatively low due to the coarse grain structure, also called microstructure, as a result of the low cooling rate during solidification.

In sand casting, due to the low cooling rate during solidification, the resulting microstructure of the cast aluminum components is usually coarse having large dendrite arm spacing (DAS) and high porosity as compared to smaller DAS in metal mold casting, which has a higher cooling rate during solidification. As a result, mechanical properties such as ductility, ultimate tensile strength (UTS) and fatigue strength of the sand casting are generally lower than metal mold casting.

Thus, while the current method of aluminum sand casting components serves their intended purpose, there is a need for a system and method to increase the cooling rate in sand castings during solidification to improve the ductility, UTS, and fatigue strength of cast aluminum components.

SUMMARY

According to several aspects, a system for increasing a cooling rate of a metal sand casting during solidification is provided. The system includes a sand mold defining a mold cavity, a coolant passageway surrounding a portion of the mold cavity, and a coolant inlet port in fluid connection with the coolant passageway. The coolant inlet port is operable to receive a coolant in a liquid phase and the coolant passageway is operable to channel the coolant as the coolant transforms from a liquid phase to a gas phase.

In an additional aspect of the present disclosure, the coolant is a cryogenic liquid selected from the group consisting of argon, helium, and nitrogen.

In another aspect of the present disclosure, the coolant is a refrigerant selected from the group consisting of a chlorofluorocarbons (CFC), a hydrochlorofluorocarbons (HCFC), and a hydrofluorocarbons (HFC).

In another aspect of the present disclosure, the sand mold includes an internal mold surface defining the mold cavity; a first region located between the internal mold surface and the coolant passageway, wherein the first region includes a first permeability; and a second region located between the coolant passageway and an external boundary of the sand mold, wherein the second region includes a second permeability. The first permeability is greater than the second permeability.

In another aspect of the present disclosure, the sand mold further defines a coolant outlet port, wherein the coolant outlet port is at least one of: (i) in indirect fluid communications with the coolant passageway such that the gas phase permeates the sand mold before entering the coolant outlet port and (ii) in direct fluid communication with the coolant passageway.

In another aspect of the present disclosure, the system further includes a coolant vapor extraction system having a vacuum pump configured to extract the gas phase of the coolant from the sand mold.

In another aspect of the present disclosure, the sand mold includes an internal mold surface defining the mold cavity and a heat sink disposed in the sand mold between the coolant passageway and the internal mold surface.

According to several aspects, a system for increasing a cooling rate of a metal sand casting is disclosed. The system includes a sand mold defining a mold cavity, and a coolant inlet port extending into the manufactured sand mold. The coolant inlet port is operable to receive a cryogenic liquid. The sand mold includes a permeability sufficient for the cryogenic liquid to transform into a gas phase while permeating through the manufactured sand mold.

In an additional aspect of the present disclosure, the sand mold includes a myriad of coolant passageways surrounding a portion of the mold cavity. The coolant passageways are in fluid connection with the coolant inlet port and operable to accommodate the cryogenic liquid changing from a liquid phase to the gas phase.

In another aspect of the present disclosure, the sand mold further includes a coolant outlet port in fluid communication with the coolant passageways.

In another aspect of the present disclosure, the system further includes a coolant vapor extraction system having a collection manifold in fluid connection with the outlet port of the sand mold.

In another aspect of the present disclosure, the sand mold is manufactured by 3-D printing with varying sized grains of sand.

According to several aspects, a method of increasing a cooling rate of a metal sand casting is provided. The method includes pouring molten metal into a mold cavity defined by a manufactured sand mold, introducing liquid nitrogen in the sand mold such that the liquid nitrogen transforms from a liquid phase to a gas phase as the nitrogen permeates through the sand mold, thereby increasing a cooling rate of the molten metal, and extracting the gas phase by applying a vacuum.

In an additional aspect of the present disclosure, the method further includes 3-D printing the manufactured sand mold to define the mold cavity, a passageway surrounding a portion of the mold cavity, an inlet port in fluid connection with the passageway, and an outlet port in fluid connection with the passageway.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
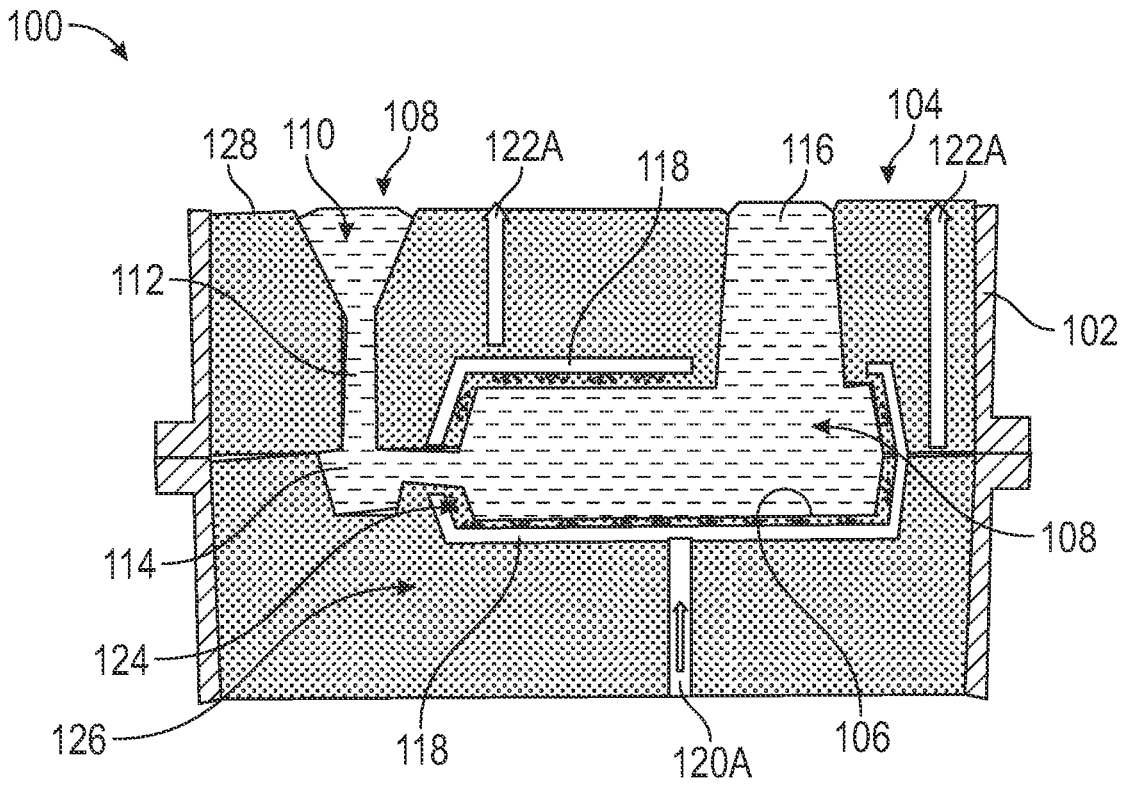
FIG. 1 is a diagram of a system for increasing the cooling rate of aluminum sand casting during solidification, according to a first exemplary embodiment.

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale and some features may be exaggerated or minimized to show details of particular features. The specific structural and functional details disclosed are not intended to be interpreted as limiting, but as a representative basis for teaching one skilled in the art as to how to practice the disclosed concepts.

"The term "about" as used herein is known by those skilled in the art. Alternatively, the term "about" includes +/−0.5% of the recited value. While examples have been described in detail, those familiar with the art to which this disclosure relates will recognize various alternative designs and examples for practicing the disclosed method within the scope of the appended claims.

In sand casting, due to the low cooling rate during solidification, the resulting microstructure of the cast aluminum components is usually coarse having large dendrite arm spacing (DAS) as compared to smaller DAS in metal mold casting. The DAS is approximately 60 microns for sand casting as compared to approximately 20 microns for metal mold casting. The smaller DAS in metal mold casting is due to high cooling rate during solidification. As a result of the larger DAS in sand casting, mechanical properties such as ductility, ultimate tensile strength (UTS) and fatigue strength of the cast aluminum components are generally lower than those of metal mold casting. To limit the size of DAS and minimize porosity in the sand cast component, a method and multiple exemplary embodiments of a system for increasing the cooling rate of the aluminum sand casting during solidification is provided.

The method and system introduce a phase changing liquid coolant into a sand mold, in which the coolant changes state from a liquid phase to a gas phase as the coolant permeates through the sand mold, thereby increasing the cooling rate of the casting during solidification. The sand mold defines a mold cavity for receiving a molten aluminum alloy suitable to form a cast automotive component. The coolant in liquid phase is introduced into flow passages defined through the sand mold, during or after the molten aluminum is poured into the mold cavity. The liquid coolant gases out, changing state from a liquid phase to a gas phase, and permeates through the sand mold, thereby increasing the cooling rate of the casting during the solidification stage of the casting process. The resulting gas phase is extracted from the sand mold to avoid or minimize gas porosity in the cast component.

The coolant may be that of a cryogenic liquid or a refrigerant that are in a gas phase at ambient temperature of about 25° C. and pressure of about 1 atmosphere (atm). A cryogenic liquid is defined as a liquid having a boiling point below −150° C. Examples of cryogenic liquid include, but are not limited to, argon, helium, nitrogen, hydrogen, methane, oxygen, and mixtures thereof. It is preferable that the cryogenic liquid is inert in both the liquid and gas phases, such as argon, helium, nitrogen, and mixtures thereof. Nitrogen is more preferable due to its abundance and low cost. Examples of refrigerants include, but are not limited to chlorofluorocarbons (CFC), hydrochlorofluorocarbons (HCFC), and hydrofluorocarbons (HFC).

While an aluminum casting alloy and cast automotive components are used for description purposes, the method and multiple exemplary embodiments of the system may be utilized for most other metal casting alloys such as iron, steel, magnesium, copper, zinc, and other alloys suitable for casting automotive and non-automotive components.

FIGS. 1 through 4 show four alternative embodiments of a system (System 100, System 200, System 300, System 400) for increasing the cooling rate of metal sand casting, such as aluminum sand casting, during solidification. Each of the Systems 100, 200, 300, 400 shown includes a metal flask 102 containing a manufactured sand mold 104 having an internal mold surface 106. The internal mold surface 106 includes protruding details and cavities to define a mold cavity 108 having a predetermined shape and geometry for forming the desired contours and features of a cast component. For example, such protruding details and cavities can form ports and other features of cylinder blocks, cylinder heads, and structural components. Manufactured sand molds 104 are often formed of a refractory material such as sand and a suitable binder material to encourage the mold cavity 108 to maintain its predetermined shape and geometry.

While a metal flask 102 is shown in each of the four alternative embodiments of the system 100, 200, 300, 400, it should be appreciated that the metal flask 102 is not necessary for certain manufactured sand molds 104. For example, for sand molds having chemical binding agents, a metal flask 102 may not be necessary since sand molds manufactured with chemical binding agents have sufficient strength to maintain its structural integrity without the aid of a metal flask 102. A metal flask 102 is typically used to contain sand molds manufactured of compressed bentonite-bonded sand, also known as green sand.

In the examples shown, the sand mold 104 defines a gating system 108 having a funnel 110, a sprue 112, a runner 114, and a riser 116. A molten metal, such as a molten aluminum casting alloy, is poured into the funnel 110 and channeled through the sprue 112 to the runner 114. The runner 114 in turn distributes the molten metal into the mold cavity 108. Most metals are less dense as a liquid than as a solid, therefore the castings may shrink upon cooling. Excess molten metal fills the riser 116, which functions as a feeder during solidification, to prevent shrinkage of the cast component.

The manufactured sand mold 104 further defines a myriad of coolant passageways 118, an inlet port 120A, 1208, 120C, 120D in direct fluid connection with the coolant passageways 118, and at least one outlet port 122A, 122B, 122C, 122D operable to collect and covey gaseous coolant out of the sand mold 104. The outlet port 122A, 122B, 122C, 122D may be in direct fluid connection with the coolant passageways 118. The outlet port 122A, 1228, 122C, 122D may also be spaced from coolant passageways 118, in which case the coolant gas permeates through the sand mold 104 to the outlet port 122A, 122B, 122C, 122D, or allowed to vent to the ambient atmosphere if an inert coolant is used.

The coolant passageways 118 are defined proximal to the mold cavity 108 such that heat from the molten metal is efficiency transferred to the coolant flowing through the coolant passageways 118. The change in phase of the coolant from a liquid to a gas as it flows through the coolant passageways 118 and permeates through the manufactured sand mold 104 increases the cooling rate of the casting during the solidification process.

The manufactured sand mold 104 may also include a first region 124 and a second region 126 having different permeability. The first region 124 is located between the coolant passageways 118 and the mold cavity 108. The second region 126 is located between the coolant passageways 118 and an outer boundary of the manufactured sand mold 104, such as a top surface 128 or the metal flask 102. The first region 124 includes a first permeability greater than a second permeability of the second region 126. For example, the first permeability in the first region 124 is $10^{-2}$ to $10^{-3}$ centimeter/second (cm/s) and the second permeability in the second region 126 is $10^{-3}$ to $10^{-5}$ cm/s. The difference in permeability may be effectuated by additive manufacturing such as 3-dimensional (3D) printing the manufactured sand mold 104 by using different size grains of sand.

The passageways 118 for the liquid coolant introduction in the sand mold 104 may also be manufactured by also using 3-D printing. 3-D printing enables complex coolant passageway shapes and routes, which may be difficult or impossible to form with traditional sand casting, as well as variable permeability of the sand mold.

The timing of the liquid coolant introduction to the sand mold 104 can be calculated based on casting mold filling and solidification simulations. For example, for casting a component having a size approximately that of a typical engine block may have a mold filling time of about 15 to 30 seconds followed by a solidification time, depending on mold geometry, of about 30 seconds to 600 seconds.

Referring to FIG. 1, the inlet port 120A is defined in the sand mold 104 beneath the mold cavity 108, with respect to the direction of gravity. The outlet port 122A is defined in the sand mold 104 above the mold cavity 108. In this embodiment, System 100, the coolant in liquid phase, also referred to as liquid coolant, flows into the coolant passageways 118 from the bottom of the sand mold 104, changes state to a gas phase, also referred to as a coolant gas, as the coolant flows through the coolant passageways 118 and permeates through the sand mold 104 in an upward direction. The coolant gas is then collected by the outlet port 122A rising upward out of the sand mold 104. If the coolant is inert, such as helium or nitrogen, the coolant gas exiting the manufactured mold may be released to the ambient atmosphere.

Figure 2:
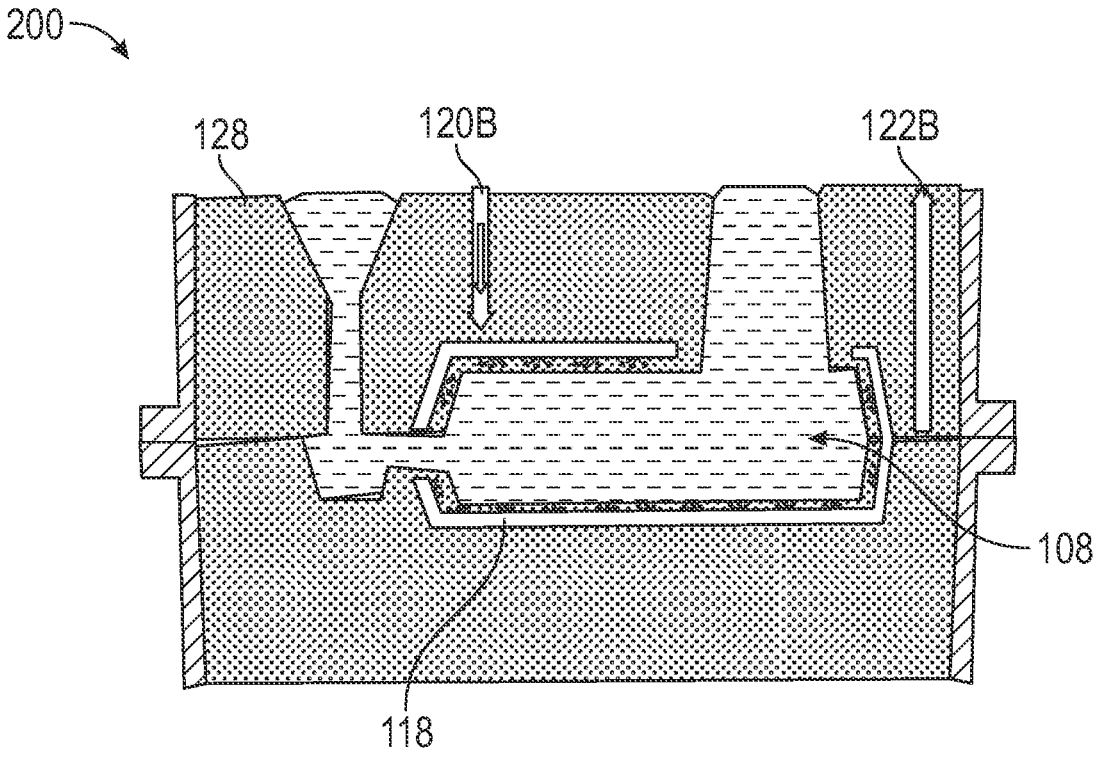
FIG. 2 is a diagram of a system for increasing the cooling rate of aluminum sand casting during solidification, according to a second exemplary embodiment.

Referring to FIG. 2, the inlet port 120B is defined in the sand mold 104 from above the mold cavity 108, with respect to the direction of gravity. The outlet port 122B is defined in the sand mold 104 from above the mold cavity 108 to the top surface 128 of the sand mold 104. In this embodiment, System 200, the liquid coolant flows downward under the force of gravity into the coolant passageways 118 from the top surface 128 of the manufactured sand mold 104, changes state to a gas phase as the coolant flows through the coolant passageways 118 and permeates through the sand mold 104. The coolant gas then rises out of the outlet ports 122A or released to the ambient atmosphere if the coolant is inert.

Figure 3:
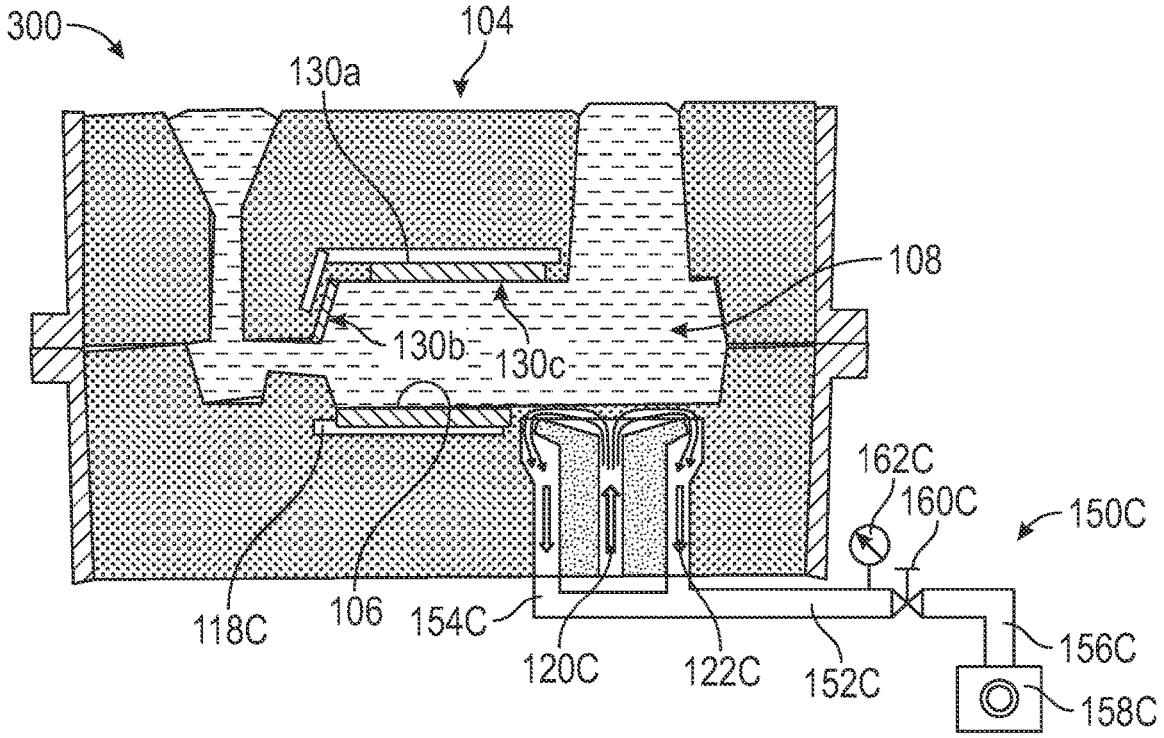
FIG. 3 is a diagram of a system for increasing the cooling rate of aluminum sand casting during solidification, according to a third another exemplary embodiment.
Figure 4:
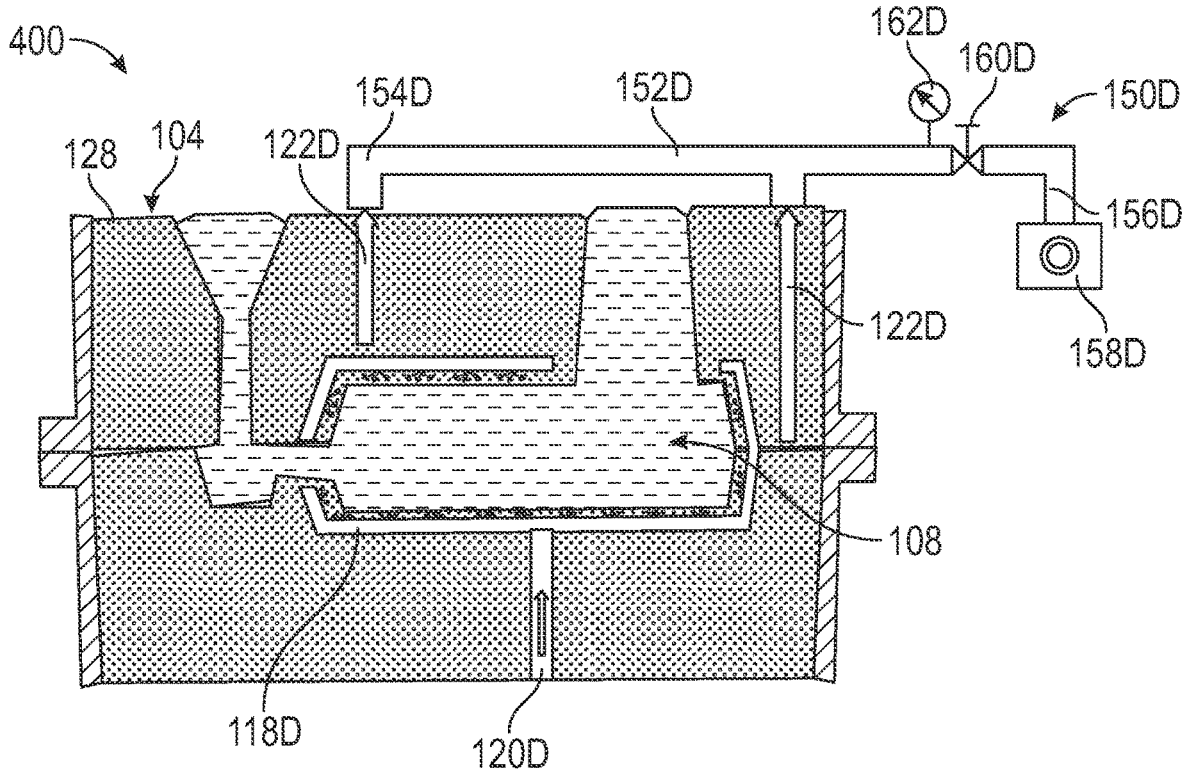
FIG. 4 is a diagram of a system for increasing the cooling rate of aluminum sand casting during solidification, according to a fourth exemplary embodiment.

Referring to FIGS. 3 and 4. Each of the System 300 and System 400 includes a coolant gas extraction system 150C, 150D. The coolant gas extraction system 150C, 150D includes a manifold 152C, 152D having at least one inlet 154C, 154D connectable to the at least one outlet port 122C, 122D and an opposite outlet 156C, 156D connectable to a vacuum pump 158C, 158D. The manifold 152 includes a vacuum valve 160C, 160D positioned between the inlet 154C, 154D and the outlet 156C, 156D and a pressure gauge 162C, 162D positioned between the vacuum valve and the at least one inlet. The vacuum valve 160C, 160D is operable to control the amount of vacuum desired.

Referring to FIG. 3, the inlet port 120C is defined in the sand mold 104 from beneath the mold cavity 108, with respect to the direction of gravity. The outlet port 122C is also defined in the sand mold 104 beneath the mold cavity 108. The inlet 154C of the coolant gas recovery system 150C is in fluid connection with the outlet ports 122C. In this embodiment, System 300, the liquid coolant flows into the coolant passageways 118 from the bottom of the manufactured sand mold 104, changes state to a gas phase as the coolant flows through the coolant passageways 118 and permeates through the sand mold 104. The coolant gas is then evacuated through the outlet port 122C under vacuum. A plurality of heat sinks 130*a*, 130*b*, 130*c*, also referred to as chill plates 130*a*, 130*b*, 130*c*, may be placed in predetermined locations at the interface of the mold cavity 108 to further increase the cooling rate of the cast component at specific locations. The heat sinks 130*a*, 130*b*, 130*c*, may be formed of any heat conductive material such as aluminum and copper, and coated with a refractory coating such as silica and mica.

Referring to FIG. 4, the inlet port 120D is defined in the sand mold 104 from beneath the mold cavity 108, with respect to the direction of gravity. The outlet port 122D is defined in the sand mold 104 from above the mold cavity 108 to the surface 128 of the sand mold 104. In this embodiment, System 400, the liquid coolant flows into the coolant passageways 118 from the bottom of the manufactured sand mold 104, changes state to a gas phase as the coolant flows through the coolant passageways 118 and permeates through the sand mold 104 through the manufactured sand mold 104 and into the outlet port under vacuum.

Figure 5:
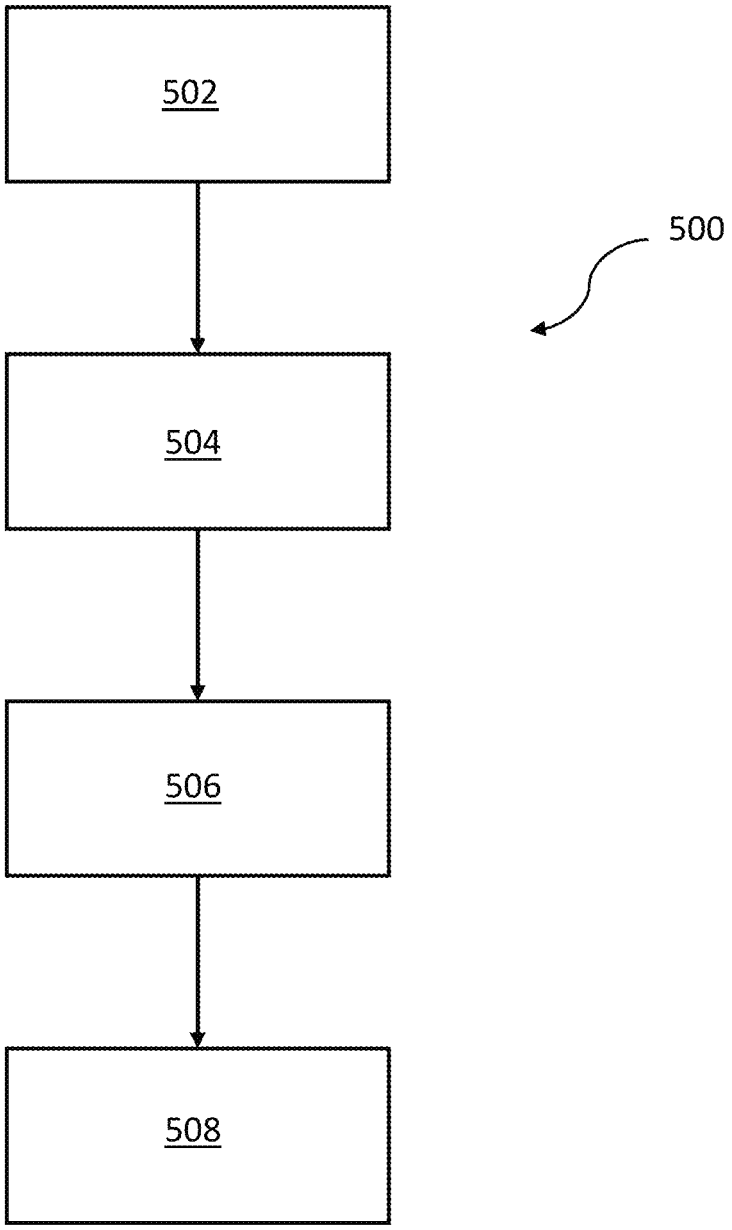
FIG. 5 is block flow-diagram of a method of increasing the cooling rate of aluminum sand casting during solidification, according to an exemplary embodiment.

FIG. 5 shows a block flow diagram of a method of increasing the cooling rate of aluminum sand casting during solidification. The method starts in Block 502 where a sand mold 104 is additively manufactured by 3-D printing. An inorganic binding agent may be used during the 3-D printed process to encourage the manufactured sand molds 104 to maintain its predetermined shape and geometry. The sand mold 104 defines a mold cavity 108, a gating system for filling the mold cavity 108 with a molten metal, and a myriad of coolant passageways 118 surrounding the mold cavity 108. The coolant passageways 118 include an inlet port 120 at least one outlet port 120. The sand mold 104 may include a first permeability region 124 located between the mold cavity 108 and the coolant passageways 118, and a second permeability region 126 located between the coolant passageways 118 and an external boundary 128 of the sand mold 104. Various size sand grains may be used for the 3D-printing to control the permeability of the different regions 124, 126.

Moving to Block 504, a molten casting alloy is poured into the mold cavity 108 through a grating system. Concurrently with the pour or shortly thereafter, a liquid coolant is introduced into the coolant passage via the coolant inlet. The liquid coolant, such as liquid nitrogen, changes state from a liquid phase into a gas phase as the coolant flows through the coolant passageways 118 and permeates through the sand mold 104, thereby increasing the cooling rate of the metal casting during solidification. The timing of liquid nitrogen introduction to the sand mold 104 may be calculated based on casting mold filling and solidification simulation Moving to block 506, the exiting gas phase of the coolant is collected by the outlet port 122 or exhausted into the ambient atmosphere. It is desirable that the maximum gas pressure in the sand mold 104 adjacent the mold surface to be about less than 0.1 atm difference compared with the local metallostatic pressure of molten metal. A vacuum may be pulled to encourage the coolant gas to exit the sand mold 104 to prevent the gas phase from permeating into the mold cavity 108, which might potentially cause undesired porosity in the cast component.

Moving to Block 508, after the solidified casting is cooled to room temperature, the sand mold 104 is broken open to remove the cast component and the method 500 ends.

The above disclosed system and method for increasing the cooling rate of aluminum sand casting during solidification is applicable to any sand-casting processes including, but not limited to, gravity pouring, low pressure casting process, Cosworth, and Electromagnetic (EM) pump. The system and method increase the cooling rate of metal sand castings during solidification, thereby providing refined microstructure and reduced casting defects to improve the casting quality and performance.

The description of the present disclosure is merely exemplary in nature and variations that do not depart from the general sense of the present disclosure are intended to be within the scope of the present disclosure. Such variations are not to be regarded as a departure from the spirit and scope of the present disclosure.

What is claimed is:

1. A system for increasing a cooling rate of a metal sand casting, comprising:

a sand mold defining a mold cavity, a coolant passageway surrounding a portion of the mold cavity, and a coolant inlet port in fluid connection with the coolant passageway;

wherein the coolant inlet port is operable to receive a coolant in a liquid phase and the coolant passageway is operable to channel the coolant as the coolant transforms from the liquid phase to a gas phase; and wherein the sand mold includes:

an internal mold surface defining the mold cavity;

a first region located between the internal mold surface and the coolant passageway, wherein the first region includes a first permeability; and a second region located between the coolant passageway and an external boundary of the sand mold, wherein the second region includes a second permeability; and wherein the first permeability is greater than the second permeability.

2. The system of claim 1, wherein the coolant inlet port is configured to receive a cryogenic liquid selected from the group consisting of argon, helium, and nitrogen.

3. The system of claim 1, wherein the coolant inlet port is configured to receive a liquid nitrogen.

4. The system of claim 1, wherein the coolant inlet port is configured to receive a refrigerant selected from the group consisting of a chlorofluorocarbons (CFC), a hydrochlorofluorocarbons (HCFC), and a hydrofluorocarbons (HFC).

5. The system of claim 1, wherein the sand mold further defines a coolant outlet port, wherein the coolant outlet port is at least one of: (i) in indirect fluid communications with the coolant passageway such that the gas phase permeates the sand mold before entering the coolant outlet port and (ii) in direct fluid communication with the coolant passageway.

6. The system of claim 5 further comprising a coolant vapor extraction system having a vacuum pump configured to extract the gas phase of the coolant from the sand mold.

7. The system of claim 6, wherein the coolant vapor extraction system includes a vacuum pump and a manifold in fluid connection with the vacuum pump, wherein the manifold includes a vacuum inlet in fluid connection with the coolant outlet port of the sand mold.

8. The system of claim 1, wherein the sand mold includes:

a heat sink disposed in the sand mold between the coolant passageway and the internal mold surface.

9. The system of claim 5, wherein the coolant inlet port is positioned at a lower portion of the sand mold or at an upper portion of the sand mold, and the coolant outlet port is positioned within the sand mold.

10. A system for increasing a cooling rate of a metal sand casting, comprising:

a sand mold defining a mold cavity, and a coolant inlet port extending into the sand mold, wherein the coolant inlet port is operable to receive a cryogenic liquid, wherein the sand mold includes:

a permeability sufficient for the cryogenic liquid to transform into a gas phase while permeating through the sand mold;

a myriad of coolant passageways surrounding a portion of the mold cavity, wherein the coolant passageways are in fluid connection with the coolant inlet port and operable to accommodate the cryogenic liquid changing from a liquid phase to the gas phase; and a coolant gas outlet port in fluid communication with the coolant passageways; and a coolant vapor extraction system having a collection manifold in fluid connection with the coolant gas outlet port of the sand mold.

11. The system of claim 10, wherein the sand mold is manufactured by 3-D printing with varying sized grains of sand to define a first region having a first permeability and a second region having a second permeability, wherein the first permeability is greater than the second permeability.

12. A method of increasing a cooling rate of a metal sand casting, comprising:

pouring molten metal into a mold cavity defined by a manufactured sand mold;

introducing a liquid nitrogen in the manufactured sand mold such that the liquid nitrogen transforms from a liquid phase to a gas phase as the nitrogen permeates through the manufactured sand mold, thereby increasing a cooling rate of the molten metal;

3-D printing the manufactured sand mold, before pouring the molten metal, to define the mold cavity, a passageway surrounding a portion of the mold cavity, and an inlet port in fluid connection with the passageway;

wherein the inlet port is operable to receive the liquid nitrogen and the passageway is operable to channel the liquid nitrogen as the liquid nitrogen transforms from the liquid phase to the gas phase; and extracting the gas phase from the manufactured sand mold by applying a vacuum.

13. The method of claim 12, wherein 3-D printing the manufactured sand mold further includes defining an outlet port in fluid connection with the passageway; and further includes applying the vacuum on the outlet port.

14. The method of claim 13, wherein 3-D printing the manufactured sand mold further includes disposing a heat sink between the passageway and the mold cavity.

15. The system of claim 10, wherein the coolant inlet port is positioned at a lower portion of the sand mold.

16. The system of claim 10, wherein the coolant inlet port is positioned at an upper portion of the sand mold.

17. The system of claim 10, wherein the coolant gas outlet port is positioned within the sand mold.

18. The system of claim 10, further includes a heat sink disposed in the sand mold between the coolant passageways and the mold cavity.

19. The system of claim 10, wherein the sand mold includes a first region having a first permeability and a second region having a second permeability, wherein the first permeability is greater than the second permeability.

20. The system of claim 10, wherein the coolant vapor extraction system includes a vacuum pump in connection with the collection manifold.

* * * * *